US008157068B2

(12) United States Patent
Sapyta

(10) Patent No.: US 8,157,068 B2
(45) Date of Patent: Apr. 17, 2012

(54) STORAGE CONTAINER AND DISPLAY SYSTEM FOR TOYS AND OTHER ITEMS

(75) Inventor: Rachel Theora Sapyta, San Antonio, TX (US)

(73) Assignee: Perfect World Luggage, Inc., San Antonio, TX (US)

( * ) Notice: Subject to any disclaimer, the term of this patent is extended or adjusted under 35 U.S.C. 154(b) by 852 days.

(21) Appl. No.: 12/152,168

(22) Filed: May 13, 2008

(65) Prior Publication Data

US 2008/0289925 A1 Nov. 27, 2008

Related U.S. Application Data

(63) Continuation-in-part of application No. 10/856,148, filed on May 28, 2004, now Pat. No. 7,600,619.

(60) Provisional application No. 60/475,186, filed on Jun. 2, 2003.

(51) Int. Cl.
*A47C 7/00* (2006.01)

(52) U.S. Cl. ..... 190/109; 190/107; 190/110; 190/18 A; 224/583; 224/652; 224/653; 383/4; 383/38; 383/39

(58) Field of Classification Search ..... 190/107, 190/109, 110, 18 A; 383/4, 38, 39; 224/583, 224/633, 652
See application file for complete search history.

(56) References Cited

U.S. PATENT DOCUMENTS

| | | | | |
|---|---|---|---|---|
| 1,061,374 A | | 5/1913 | Harrington | |
| 1,085,950 A | | 2/1914 | Steinthal | |
| 1,866,323 A | | 7/1932 | Russel | |
| 2,112,062 A | | 3/1938 | Berger | |
| 2,463,391 A | | 3/1949 | Kanaley | |
| 3,650,381 A | | 3/1972 | Weindling | |
| 4,169,550 A | * | 10/1979 | Williams | 224/633 |
| 4,236,559 A | * | 12/1980 | Archbold | 224/610 |
| 4,243,340 A | * | 1/1981 | MacGregor | 40/312 |
| 4,287,986 A | | 9/1981 | Beck | |
| 4,386,642 A | | 6/1983 | Durbin | |
| 4,436,189 A | | 3/1984 | Baum | |
| 4,515,300 A | | 5/1985 | Cohen | |
| 4,852,293 A | | 8/1989 | Levine et al. | |
| 4,951,812 A | | 8/1990 | Chen | |
| 4,953,765 A | | 9/1990 | Little et al. | |
| 4,967,913 A | | 11/1990 | Bayer | |
| 5,002,401 A | | 3/1991 | Blackman | |
| 5,123,197 A | * | 6/1992 | Gentry et al. | 43/54.1 |
| 5,125,519 A | | 6/1992 | Cambria | |
| 5,125,523 A | | 6/1992 | Kulper | |
| 5,291,990 A | | 3/1994 | Sejzer | |
| 5,350,045 A | * | 9/1994 | Robertson | 190/110 |
| 5,489,021 A | | 2/1996 | Wallingford | |
| 5,562,204 A | | 10/1996 | Sapyta et al. | |
| 5,641,199 A | * | 6/1997 | Bond-Madsen | 297/229 |
| 6,523,653 B2 | | 2/2003 | Roegner | |
| 2002/0114539 A1 | * | 8/2002 | Strevey et al. | 383/13 |
| 2003/0024960 A1 | * | 2/2003 | Greenstein et al. | 224/153 |

FOREIGN PATENT DOCUMENTS

DE 184586 5/1907

(Continued)

*Primary Examiner* — Tri Mai
(74) *Attorney, Agent, or Firm* — Jackson Walker, LP

(57) ABSTRACT

A luggage container comprising a foldable flat member. To the inner surface of the foldable flat member I releasable attached a number of pockets in which articles may be stored and/or displayed. A single, flat, foldable member can be folded into a generally rectangular shape or laid flat or hung vertically.

3 Claims, 13 Drawing Sheets

FOREIGN PATENT DOCUMENTS

| | | | |
|---|---|---|---|
| FR | 2419692 | | 11/1979 |
| GB | 162197 | | 4/1921 |
| GB | 490148 | | 8/1938 |
| JP | 8-80214 | * | 3/1996 |

* cited by examiner

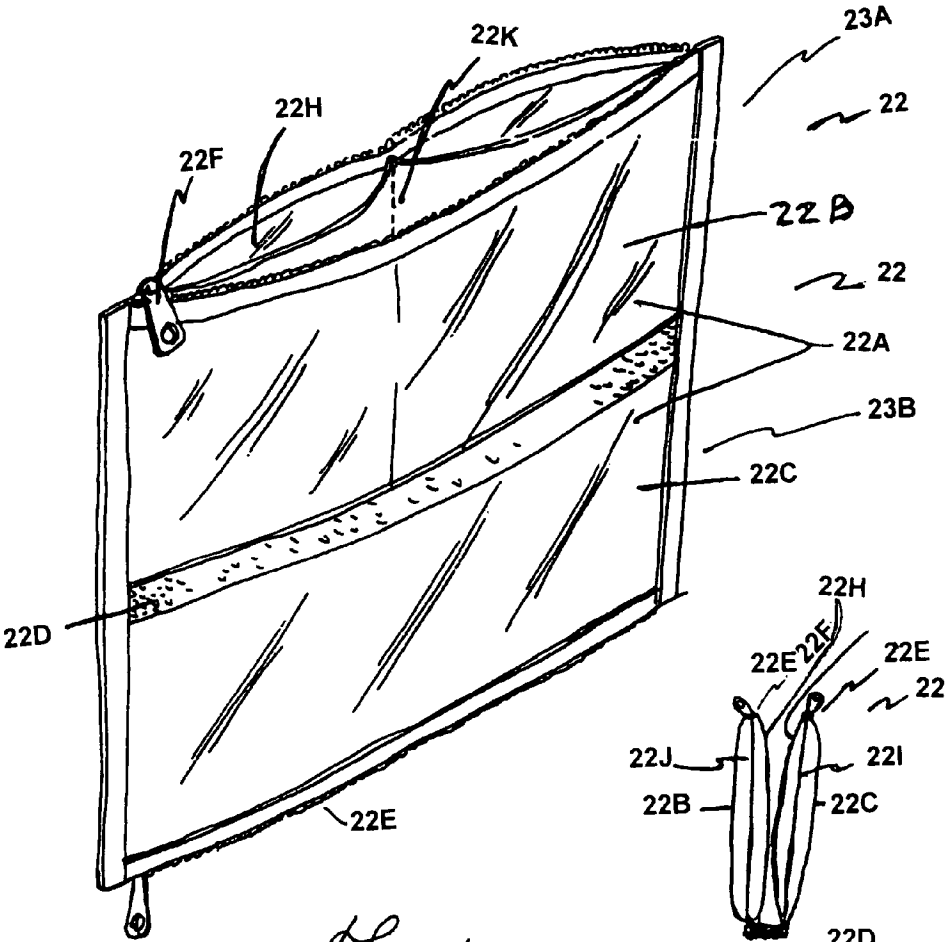
Fig. 6
Fig. 6A
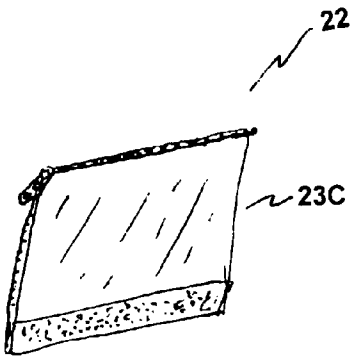
Fig 6B

STORAGE CONTAINER AND DISPLAY SYSTEM FOR TOYS AND OTHER ITEMS

This continuation-in-part application claims priority from and incorporates by reference U.S. application Ser. No. 10/856,148, filed May 28, 2004, also claiming priority from U.S. provisional Application Ser. No. 60/475,186, filed Jun. 2, 2003.

FIELD OF THE INVENTION

A luggage container, more specifically a luggage container formable from a single flat, foldable member and containing a multiplicity of unique, releasably attachable pockets.

BACKGROUND OF THE INVENTION

Prior art discloses a myriad of luggage containers in a variety of designs and constructed of a variety of different materials. A simple luggage container may be nothing more than a sack, opened at the top for receipt of items therein. However, a need exists for a more complex luggage container that is capable of storing a variety of items. There exists, in the prior art, a variety of purpose built luggage containers such as that found in U.S. Pat. No. 5,562,204 (Sapyta 1997). The '204 luggage container, while it may be adapted for multipurpose use, is especially useful in the display of veterinary or medical items.

Applicant herein provides for a novel luggage container that is adapted for a specific purpose, yet may be useful for the storage, transportation and display of, in fact, a variety of items. More specifically, Applicant has invented a novel container that has been found to be suitable for among other things the storage, transportation and display of dolls or toys and their related accessories. However, Applicant has found that such a novel luggage container is also suitable for the transportation, storage and display of a variety of items including: toys, medical implements, cosmetics, jewelry and small personal items.

Applicant sought to achieve, in an inexpensive, easy to manufacture luggage container, the capability of storing a number of rather small items, as well as a fewer larger items. For example, a "Barbie®" doll set would typically include one or more large items (the doll itself), a number of additional clothing items to clothe the doll, which would represent smaller items, and a still greater number of even smaller items such as shoes, purses, hats, etc. It may be readily appreciated by those with young children that the organization, transportation and storage of such a multiplicity of various sized items, related to one another, without losing, them is formable. Simple boxes do not work as they mix up items of different sizes. Compartmentalized boxes do not work well either unless the compartments are appropriately sized and, even then, there is difficulty in mixing up fashion accessories related to one doll that would not fit or work with another. In addition to the size and number of different items, Applicant discovered that they need to be stored properly as well as easily transported from one place to another and, in such a fashion that they could be visible and associated with one another. This will help one find small items quickly and easily.

Applicant's seeks to achieve in a novel luggage container, the ability to easily carry and transport the goods described above. Further, Applicant's novel luggage container seeks to achieve the ability to use the display items, both on the exterior and interior thereof, including documents or items that are relatively flat, as well as items that may be bulky.

Applicant also seeks to achieve the ability to disguise, at least to some degree, items or goods carried on or in the container, which may otherwise be easily viewable or accessible.

Applicant further seeks to achieve a system to code a multiplicity of novel luggage containers for easy identification of the contents thereof.

OBJECTS OF THE INVENTION

Thus, it was the object of the present invention to provide for a myriad of transportation and storage advantages in a simple, easy to use and easy to manufacture luggage container. The term luggage is used in a broad sense, a container capable of carrying a variety of items be they toy items, clothing articles, cosmetics, salesman samples or other materials.

Applicant has achieved these objects and others in providing for a luggage container having a multiplicity of removable "see through" pockets.

These objectives and others are provided for in a luggage container that contains a multiplicity of "see through" pockets that are removable and that come in a variety of sizes and shapes.

These objects and others are provided for in a novel luggage container having a multiplicity of leaf pockets as well as a multiplicity of bulk pockets. The term leaf pockets is included herein by Applicant to describe a tabular pocket, being substantial in length and width, but rather narrow in thickness. On the other hand, bulk pockets are substantial in length, width and height and more capable of carrying bulky items therein. Leaf pockets may be more suitable for a number of smaller items or for items that may be more flat laying than bulkier items. For example, a doll itself is bulky and thus would be better adapted for receipt into a bulk pocket. On the other hand, a skirt, dress or other fashion outfit which is made of a flexible fabric and may be essentially flat laying, is often adapted for receipt into a leaf pocket. Both bulk and leaf pockets, provided with walls that are transparent or at least translucent, provide the user with a clear view of the contents thereof and thus are simpler to use than an opaque pocket which would require opening and sorting through the items for proper identification of the desired object.

These and other objects are provided for in a flat laying panel having foldable sections, upon which an inner surface has removably attached thereto a multiplicity of leaf and bulk pockets in a variety of sizes and, wherein folding of the panel will provide for the capability of easy carrying when in a folded condition or display and/or use when in an unfolded position.

To achieve the stated objectives and others, Applicant has provided a novel combination of features that include a flat laying panel capable of being easily folded into a container shape (typically rectangular), the flat laying panel having a multiplicity of clear removable pockets in a variety of shapes. Applicant has further provided for achieving these and other objectives a novel arrangement of the pockets which may be arranged as leaves in a book, for ease of identifying the contents thereof and for ease of removing a pre-selected one from a multiplicity of leaf pockets.

These and other objects are attainable in a generally rectangular container providing a multiplicity of panels held together by a single zipper track carrying typically, two zippers, which single track is configured to allow the rectangular orientation or configuration of the container to be converted into a flat laying container through the operation of the two zippers of the single zipper track.

These and other objects are achieved in a novel container having pockets, including flat, tabular, external pockets, which pockets may contain a hidden compartment not apparent to the casual observer, which hidden compartment may contain documents or other items which would otherwise be visible.

Applicant's novel container may also include a frame, typically rectangular, to help support the walls thereof when in a rectangular configuration, which frame is capable of folding into a flat configuration when the container is unzipped.

BRIEF DESCRIPTION OF THE DRAWINGS

FIG. 4 is a perspective view of the panel of Applicant's container in an unfolded condition illustrating the outer surface and illustrating external pockets on a surface thereof.

FIG. 6 is a perspective view of a leaf pocket removed from the panel.

FIG. 6A is a side elevational view, cutaway, of a leaf pocket.

FIG. 6B is a perspective view of a single sheath pocket.

DETAILED DESCRIPTION OF THE PREFERRED EMBODIMENT

Figure 1:
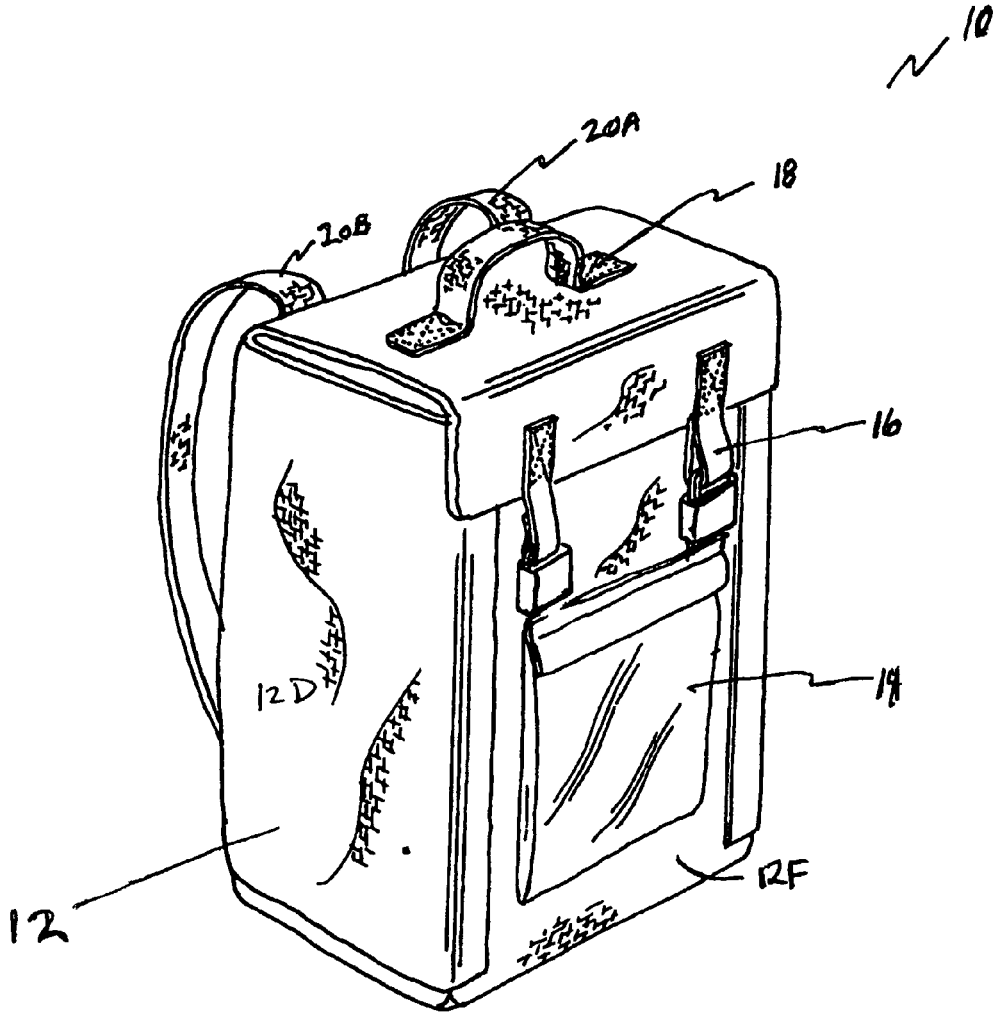
FIG. 1 is a perspective view of the novel luggage container of Applicant's present invention in a folded condition.

Turning now to FIG. 1, it is seen that Applicant provides a container (10) which may be generally rectangular and comprised of a panel (12), the panel comprising the walls of the generally rectangular container. Optionally, one or more external pockets (14) may be provided, which external pockets may be attached on one more of the external walls of the container. The container comprises a panel which may be folded to define the generally rectangular structure illustrated in FIG. 1 and may also include buckles (16) clips or other fasteners for buckling and unbuckling and providing access to the container or for laying the container out flat as set forth in FIG. 2. In addition, the container may have either a handle (18) and/or carrying straps (20A and 20B), for carrying the container as a backpack, the handle for carrying it as a hand bag. The container may have either a handle, or carrying straps or both. Indeed, in certain configurations, there may be no handle or straps, yet typically there will one or the other or both. These will provide for easy carrying of the container and the objects stored therein.

With reference to FIGS. 1, 2, 2A and 3 panel (12) is seen to include an outer surface (12A) and an inner surface (12B). Moreover, when the panel is folded into the rectangular shape illustrated in FIG. 1, the panel may define the back wall (12C), two side walls (12D), bottom wall as well as a combined bottom end/rear wall (12F). In an alternate preferred embodiment not illustrated, side walls (12D) may be omitted.

Figures 2, 2A:
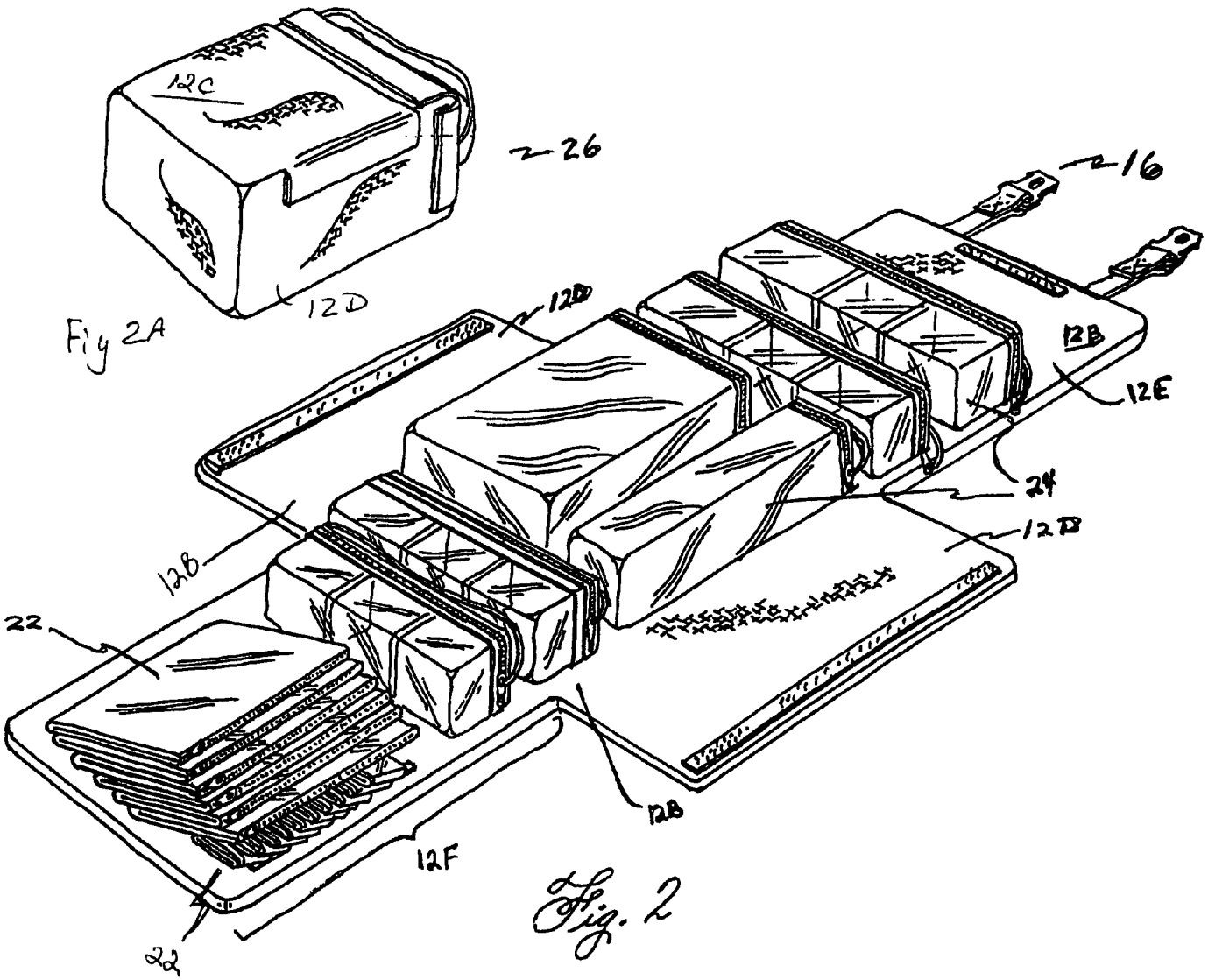
FIG. 2 is a perspective view of the inner surface of the panel of Applicant's novel container in an unfolded view and illustrating the pockets thereof.
FIG. 2A illustrates a bulky pocket in perspective view.

FIG. 2 illustrates multiplicity of pockets attached removably, as by Velcro or the like, to at least part of the inner surface (12B) in such a manner that the pockets may contain contents yet the panel may be folded in a position illustrated in FIG. 1. Velcro® comes in mating pads and is a well known hook and pile type fastener. The dashed lines in FIG. 3 define the fold lines of the panel.

Figure 8:
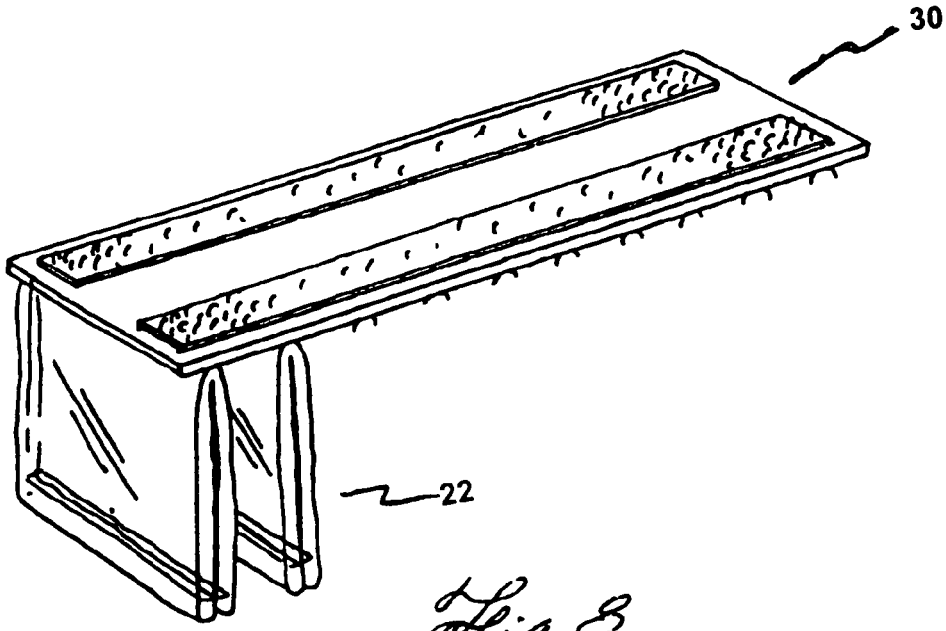
FIGS. 8 and 8A are perspective views of a manner of organizing a multiplicity of pockets for attachment to the panel and for removal from the panel as a group.

Turning back to FIG. 2, it is seen that internal leaf pockets (22) may be directly attached to the inner surface of panel (12) and arranged one to the other in "book" fashion as seen in FIG. 2. Indeed, FIG. 2 illustrates two "sheaths" or "books" comprising a multiplicity of leaf pockets arranged so that a spine thereof may be attached either directly to the inner surface of the panel or to a mounting panel which is in turn attached to the inner surface. Moreover, leaf pockets may be attached so that a zipper or Velcro-sealed edge is opposite that edge, spine or portion bound to either the panel or a mounting surface (see FIGS. 8 and 8A). Reference to FIG. 2 illustrates the tabular nature of the panels and the slim design of the leaf pockets. FIG. 2 also illustrates the bulky nature of bulk pockets (24).

Turning now to FIG. 4, it is seen that Applicant provides for, in a preferred embodiment, one or more externally mounted tabular pockets having at least an outer wall comprised of a see through material such as clear vinyl, here external pockets (14) being attached to rear wall (12F) and back wall (12C) (external surface thereof). External pockets (14) may be constructed in any fashion and be removably (preferable) or permanently attached. External pockets are an option feature of applicant's invention. Identification tab, insert, or name tag (15) may be included on some or all of the pockets, as for example, adhesive backed paper, to allow the user to identify the intended contents of the pocket.

Figure 5:
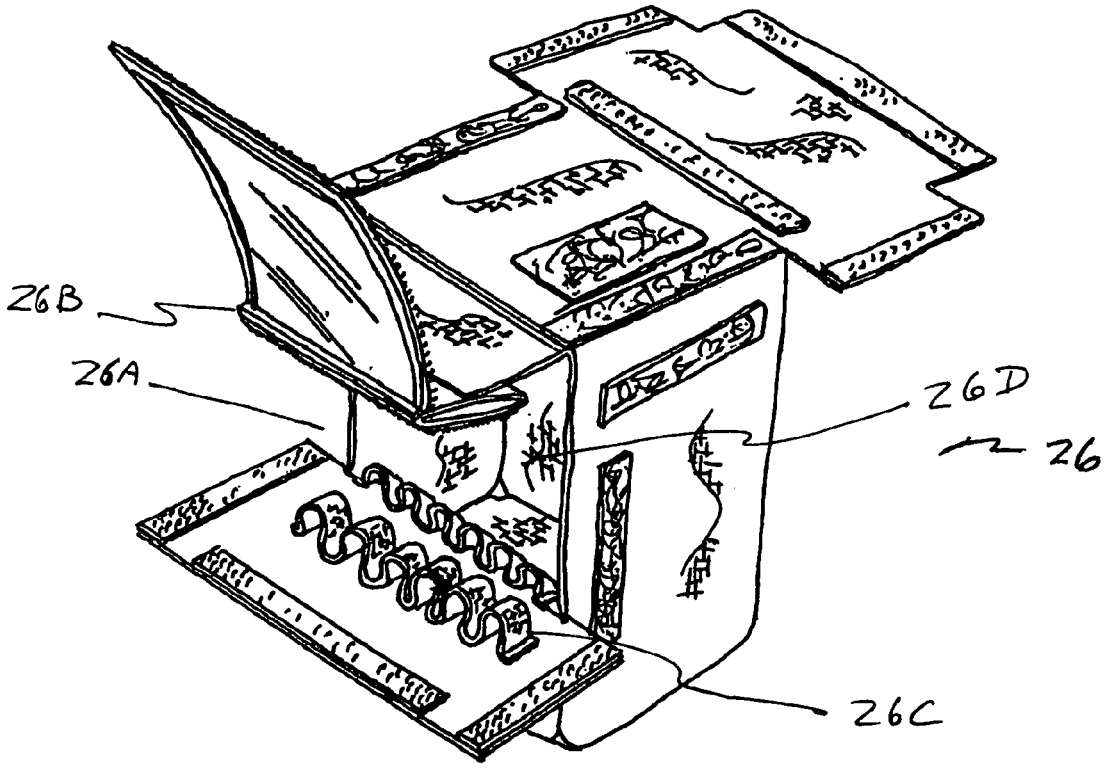
FIG. 5 is a perspective view of an example of one possible insert pack for use with Applicant's novel luggage container which insert pack is dimensioned for receipt onto the inner surface of the panel.

An optional feature of the preferred embodiment of Applicant's invention is an insert pack (26) illustrated in FIG. 5, which is in itself a small container which may be dimensioned to be received, removably, upon the inner surface of panel (12) when one or more of the pockets featured in FIG. 2 are removed. This gives Applicant's container (10) a degree of flexibility wherein one may choose to remove a series of pockets therefrom and instead place insert pack (26) therein. It is seen that insert pack is generally rectangular and, when sitting on a bottom wall, may open from the front (as opposed to opening from the top), to display the contents thereof. Insert pack (26) is a "pack within a pack," dimensioned small enough to fit with Applicant's container (10), and may itself include one or more of the features of Applicant's novel container. Here, FIG. 5 illustrates pockets (26B) and retainer loops (26C) as well as an interior volume (26D) for receipt of items therein.

FIGS. 6 and 6A illustrate details of a leaf pocket (22) of Applicant's present invention. As is noted earlier, the leaf pocket is generally thin and tabular in nature. Further, a leaf pocket such as that illustrated may have an outer cover (22A) comprising a front wall (22B) and a back wall (22C), the front and back wall separated by a Velcro spine (22D) which may attach to the inner surface of the panel either to a mounting panel or directly to a matching strip as set forth in FIGS. 2 and 3. Note in FIG. 6A that the leaf pocket (22) may be folded to represent a pair of parallel laying sheaths or leaves, and wherein at least part of walls (22B and 22C) are clear. Zippers (22E and 22F) provide easy access to the interior of the leaf pockets. Other pocket closure structures may include Velcro®, plastic slides, snaps or the like. Typically, a pair of interior walls (22H and 22G) are spaced apart and generally parallel to outer walls (22B and 22C) as set forth in FIG. 6A. There may also be an opaque interior member (22I and 22J) between the inner and outer walls, which opaque member would separate into two compartments (23A and 23B) a compartment defined by wall pairs (22C and 22G) on the one hand and (22B and 22H) on the other. That is, in a preferred embodiment of Applicant's present invention, wall members (22C and 22G) may be non-opaque and may be separated by opaque wall (22I). Likewise, walls (22B and 22H) may be non-opaque and separated by opaque wall (22J). Zippers may provide access to compartments (23A and 23B) and the compartments may be further subdivided as by stitching (22K).

FIGS. 6 and 6A illustrate a removable pocket having a pair of compartments (23A and 23B) removably connected to the surface of the container at spring leaf (22D). In an alternate embodiment illustrated in FIG. 6C, a single compartment (23C) pocket (22) is illustrated with a Velcro strip and typically at least one clear and one opaque wall.

Figure 8A:
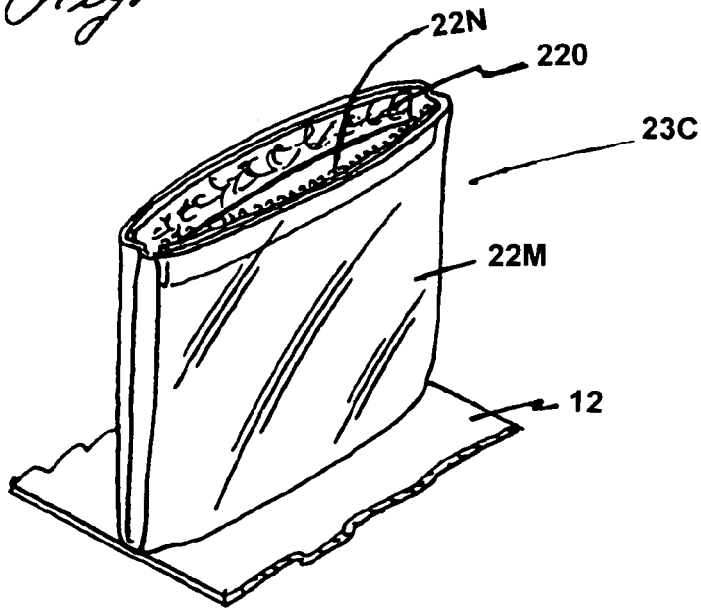

Turning for a moment to FIGS. 6B and 8A and further with reference to FIG. 2, note that Applicant may provide an alternate preferred embodiment of leaf pocket (23C) here and comprising a single sheath or leaf having a pair of walls (22N and 22M) defining an interior compartment sealed at one end adjacent to panel (12) and releasably opened, as by zipper or Velcro (22O). Note that either of the disclosed embodiments of the leaf pocket may be either directly attached to panel (12) or may be attached to a mounting panel (30) which may be removed as by Velcro or the like from the inner or outer surface of the panel. Thus, there may be a variety of combinations of leaf pockets and mounting means, for engagement with the panel. Either type of leaf pocket may be either directly attached to mounting panel as in FIG. 8, in which case a multiplicity of leaf pockets may be attached to be removed at one time from the panel, or, either type of leaf packet may be individually attached, releasably or permanently (as by sewing), to the inner surface of the panel.

Figure 3:
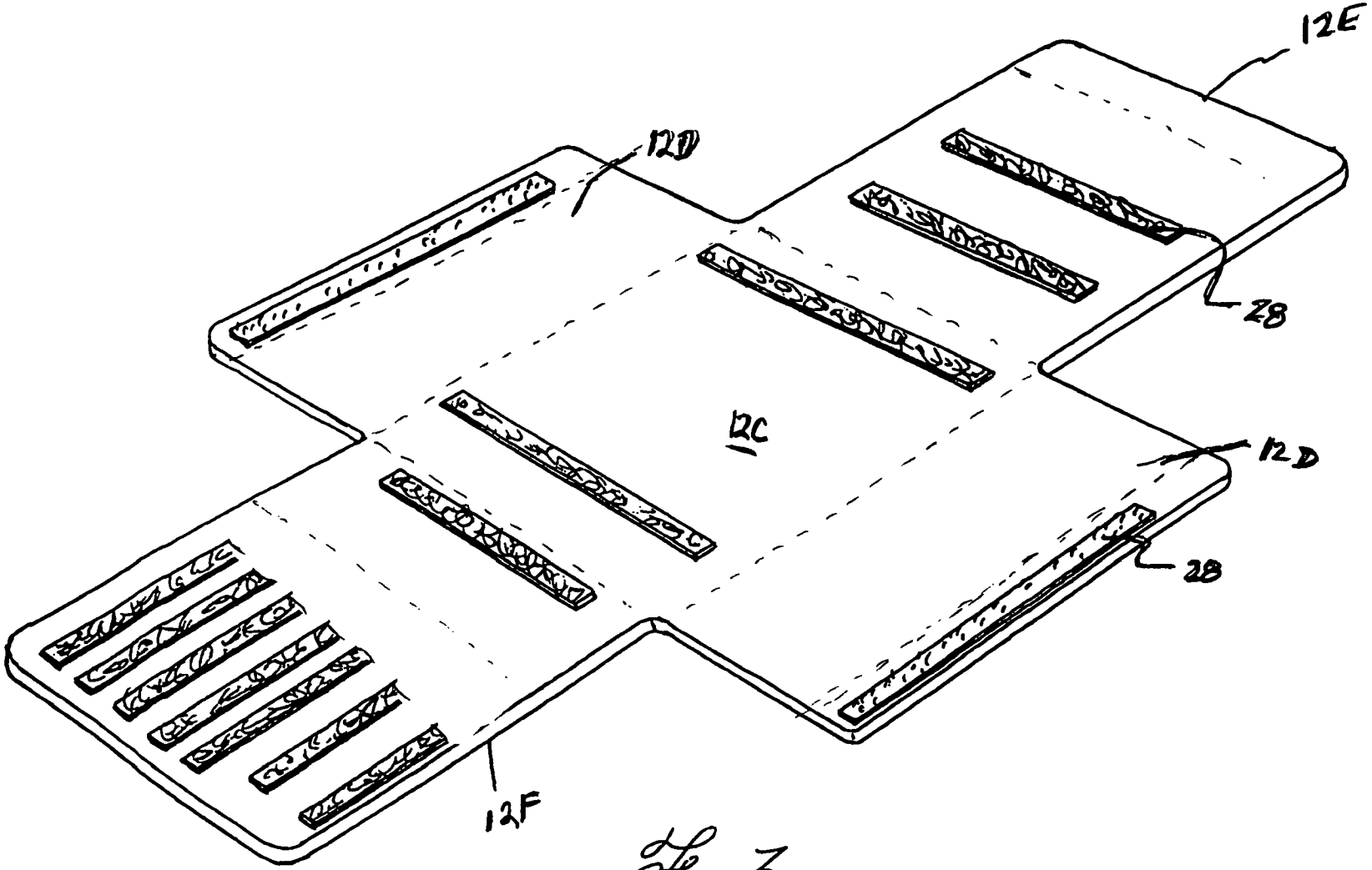
FIG. 3 is a perspective view of the panel comprising a part of Applicant's novel container, the panel with the pockets removed therefrom.
Figure 2:
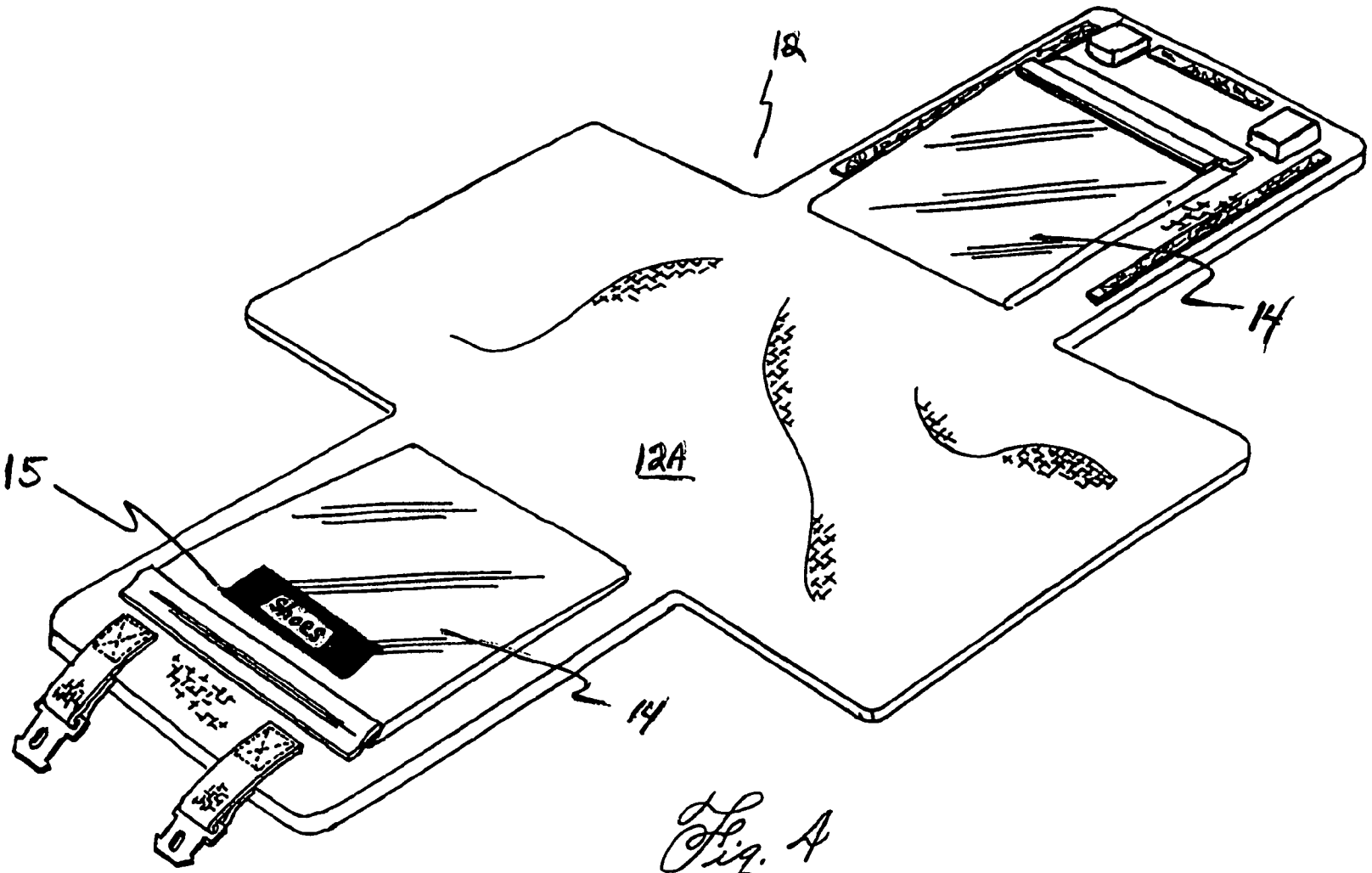
Figure 7:
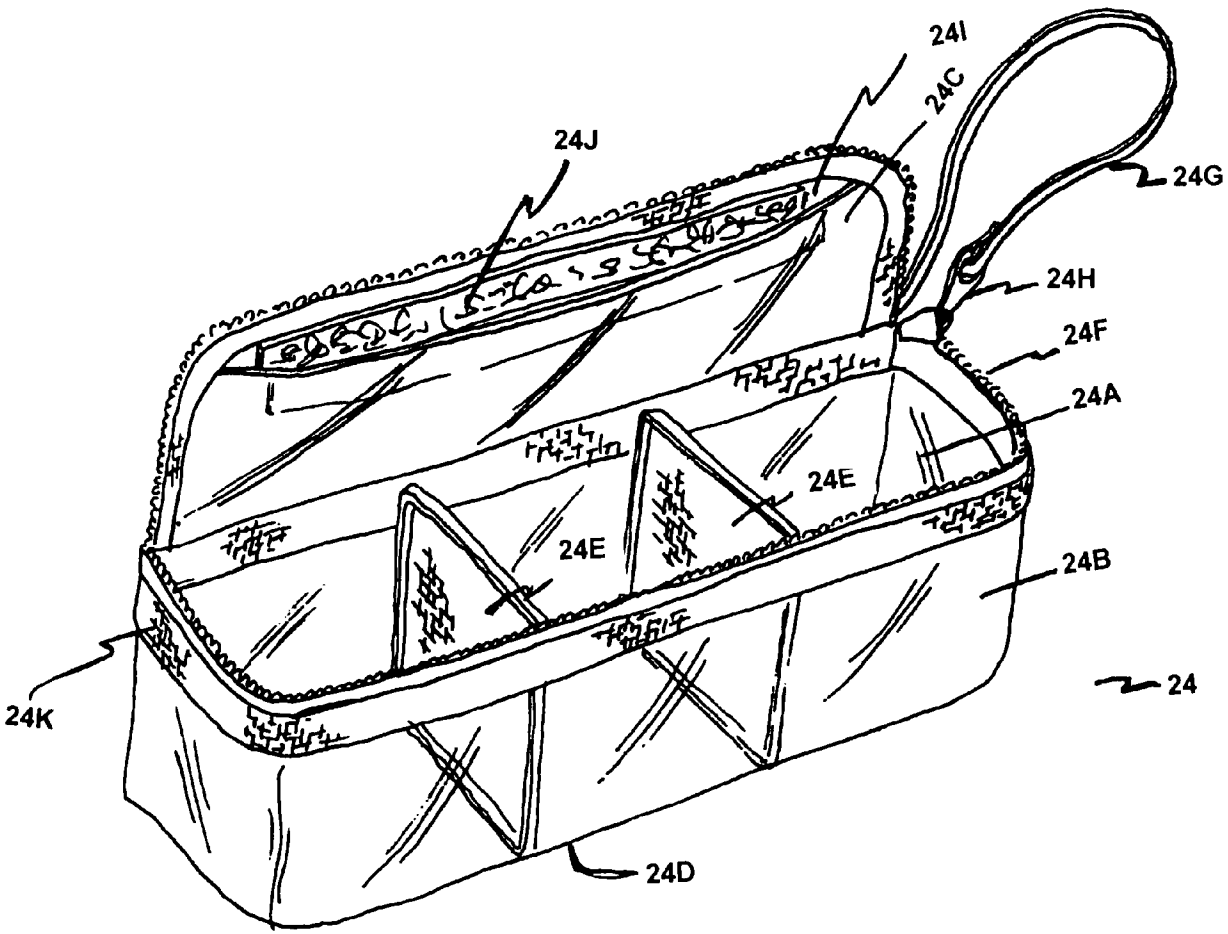
FIG. 7 is a perspective view of a bulk pocket removed from the panel.

FIG. 7 illustrates a bulk pocket (24) which is readily distinguishable from the leaf pocket in having three substantial dimensions: length, width and height, and therefore more adaptable to carrying bulky items. Further, bulk pocket (24) is seen to include an interior space (24A) defined by side walls (24B) (here four), a zippered opening top wall (24C) and a bottom wall (24D), opposite the top wall. Further, it may be seen that interior volume (24A) may be subdivided as by pocket panels (24E) which pocket panels may be opaque and/or non-opaque. Indeed, typically, at least some of the side walls, top wall and bottom wall of the bulk pockets may be clear (optionally) for the user to view the contents thereof. In another embodiment the pocket walls may be opaque. A zipper (24F) or other opening means is typically provided as is a handle, such as a strap (24G), one end of which may be attached to the zipper handle (24H) as illustrated in FIG. 7. In a preferred embodiment of bulk pocket (24) illustrated in FIG. 7, a second interior compartment (24I) is provided by having a top wall (24C) made of two sheets (clear and/or opaque) with Velcro attaching them along one border (24J). Rear enforcement strip (24K) may be provided and, where it trends along a side wall, such as the side wall on which top wall (20C) pivots, a portion of a Velcro attachment strip may be provided which in turn would mate with a Velcro attachment strip on the inner surface (12B) of panel (12) as illustrated in FIG. 3 (bulk pockets removed) and FIG. 2 (bulk pockets present).

Turning to FIG. 2, it is seen that bulk pockets may be provided in a variety of sizes, as leaf pockets are. Typical dimensional ranges for these may be L about 3 to 11 inches, W about ±2 to 1 inch, and H about 3 to 11 inches. Providing both bulk and leaf pockets and further providing each of these in different sizes provides a unique assemblage of pockets which a variety of various sized items may be stored and, which can be easily be identified since one or more of the walls of the pockets are typically non-opaque. Further, pockets can individually be removed or be removed as a group. All of these features, including the feature of a removable insert pack, provide unprecedented capabilities heretofore not found in prior art luggage containers.

Figure 9:
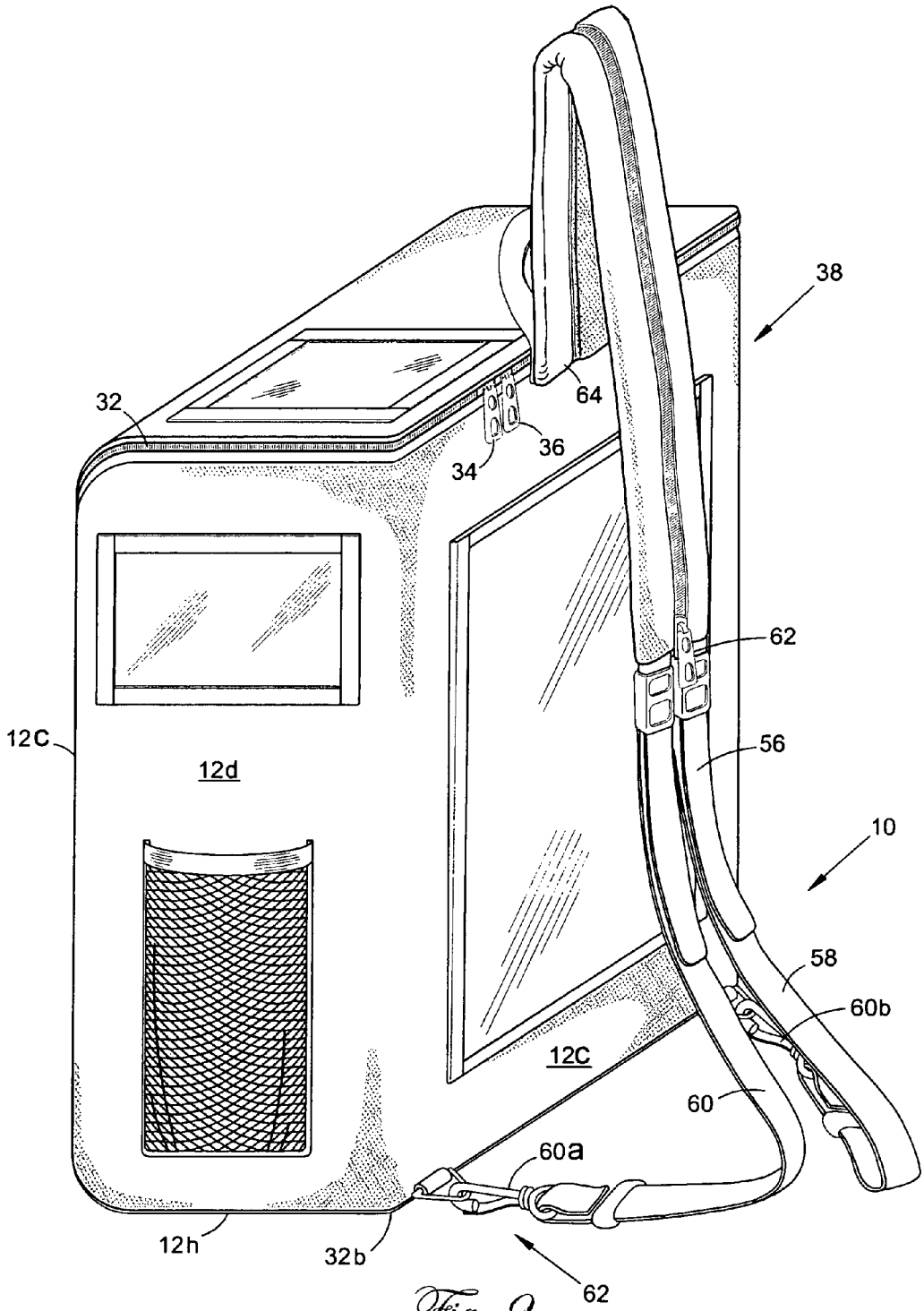
FIG. 9 illustrates in perspective view another preferred embodiment of Applicant's present design which may or may not include an internal frame, hidden external pockets, single or dual shoulder straps, and a single zipper track.
Figure 10:
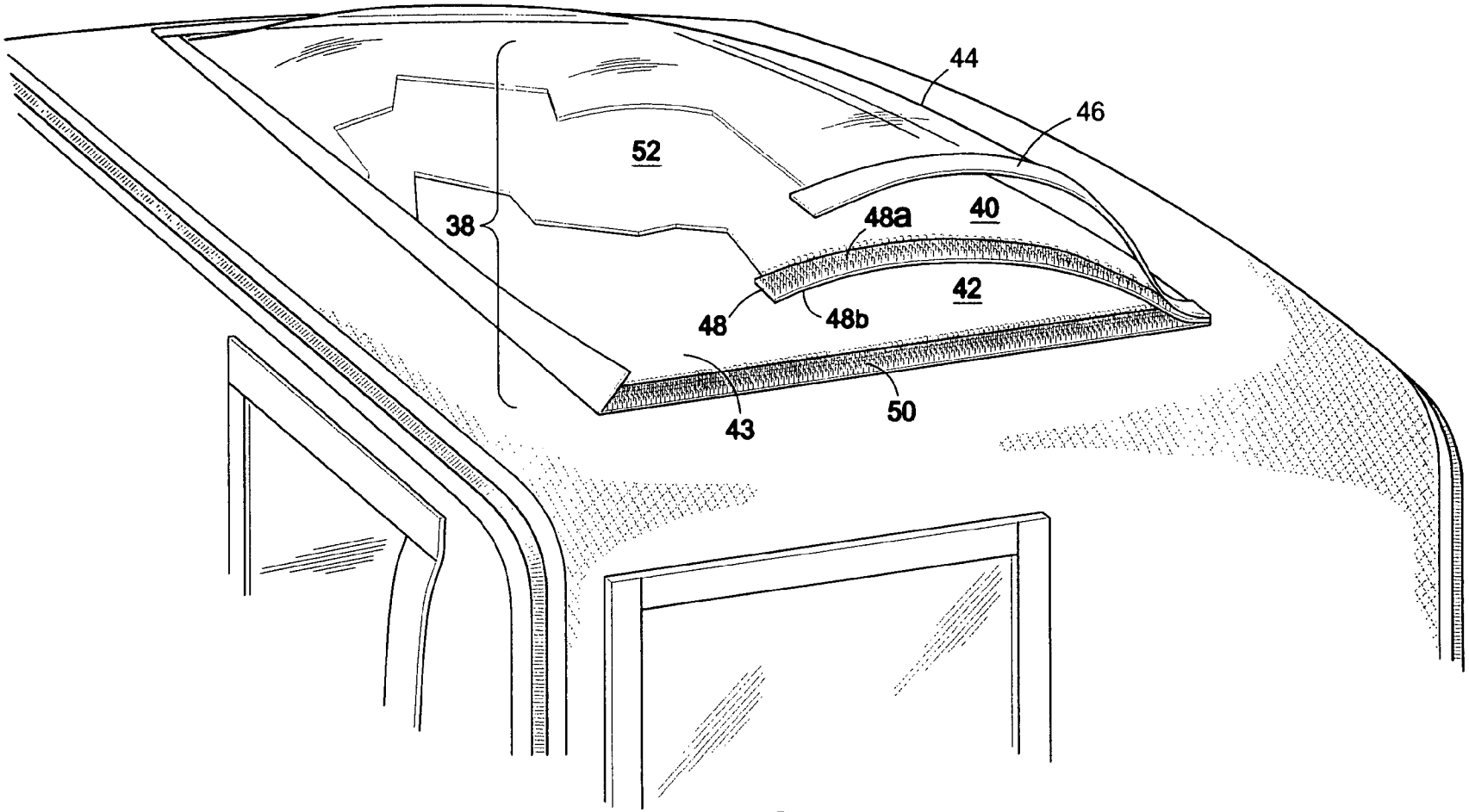
FIG. 10 is a detail view of a novel pocket having a hidden compartment for concealing the contents thereof from a casual observer.

FIGS. 9 and 10 provide external views of Applicant's novel container 10 in an alternate preferred embodiment. The alternate preferred embodiment illustrated in FIGS. 9 and 10 both are, at least in one way, different from the embodiments seen in FIGS. 1-8, in that the means to maintain the container in a folded position and having a generally rectangular shape (similar, for example, to a backpack) includes a single zipper track 32, the zipper track preferably, but not necessarily having two zippers 34/36.

Zipper track 32 is seen to have zipper track ends 32*a* and 32*b*. Moreover, it is noted that zipper track 32 provides for the releasable engagement, typically along the three sides of each sidewall of the side panels as illustrated. Where the side panels 12*d* meet the back panel 12*c*, there is typically no zipper. Further provided is removal (i.e., zipper track) along three sides of the top and bottom 12*g* and 12*h*, respectively as illustrated. The single zipper track as configured allows the formation of the rectangular or closed pack, or the flat laying pack.

FIGS. 9 and 10 also illustrate features of Applicant's novel "hidden compartment." More specifically, as seen in FIG. 9, and especially in FIG. 10, Applicant may provide a deception pocket 38, which deception pocket includes a "hidden compartment." A first sleeve compartment 40 and a second sleeve or hidden compartment 42 is provided. First compartment 40 has a clear member 34 on the exterior thereof, typically sealed around three sides (typically in rectangular configuration), as by sewing, for example, to the container fabrics. A releaseable sealing member 46, for example, Velcro® may seal at the top thereof. Releasable sealing member 46 is engageable with a intermediate sealing member 48 having a first or top surface 48*a* such that, for example, top surface 48*a* may be a hook member and the underside 48*b* of sealing member 46 may be a loop member for releasably sealing 48*a*. This will provide access to the contents of first sleeve type compartment 40. Sealing member 48 will also sit flush against sealing member 50, namely, the underside 48*b* of sealing member 48 would seal tightly to sealing member 50. Sealing member 50 provides access to hidden compartment 42. That is to say, if backing member 52 were opaque and cover 44 clear, one would see the contents of compartment 40. However, opaque backing member 52 would typically be the same material, style and color as the rest of the material comprising the exterior of the container and thus appear to be nothing more than the exterior of the container. That is to say, the compartment 40 would have a backing member 52 that looks to be the underside of the pocket and the pocket looks to be only comprised of clear cover and rear backing. A casual observer would believe the pocket is just the clear cover sewed onto the outer fabric of the rest of the container. This is especially true, since sealing member 48 is rather thin and can therefore disguise the fact that it is actually providing access to the hidden pocket compartment 42 and the contents thereof, which access is not only hidden but actually disguised from view by the casual observer. Sealing member 48 is attached to the top edge of backing member 52, which side and bottom edges of cover 44 and backing member 52. Rear or bottom wall 43 of hidden compartment 42 typically is just the panel onto which the pocket is sewn.

Applicant's novel hidden pocket may be provided in or on the exterior or interior of Applicant's novel container 10 and may be provided with a hidden compartment whose rear wall actually extends inward into the inside of the cavity of the folded container rather than flat laying as viewed in FIG. 10. The more flat laying or tabular hidden pocket as seen in FIG. 10 may accommodate flat laying goods, such as documents, passport, money, etc., but the pocket could be dimensioned to have a bottom wall of the hidden compartment to actually extend into the interior of the folded container to contain more bulky items. In that particular embodiment, however, it may be more easily to spot the hidden compartment when the container is unfolded.

FIG. 9 also illustrates Applicant's novel multi-functional, adjustable support strap 56, which is comprised of two strap members 58 and 60, which typically attach at a pair of removed ends 60*a* and 60*b* with clips to the container, typically along where the back wall meets the bottom wall. It should be further noted that straps 58 and 60 may be separated with a zipper 62 along at least a portion thereof, which separation will allow the two straps to articulate from a common joinder point 64 about the midpoint of the edge joining the back wall to the top wall as seen in FIG. 9. When the zipper is zipped as seen in FIG. 9, the strap can be slung over a single shoulder to carry the container and, if the zipper is unzipped, the container could be worn as a backpack with one strap 58/60 going over one shoulder and the other strap 58/60 going over the other shoulder.

Figure 12:
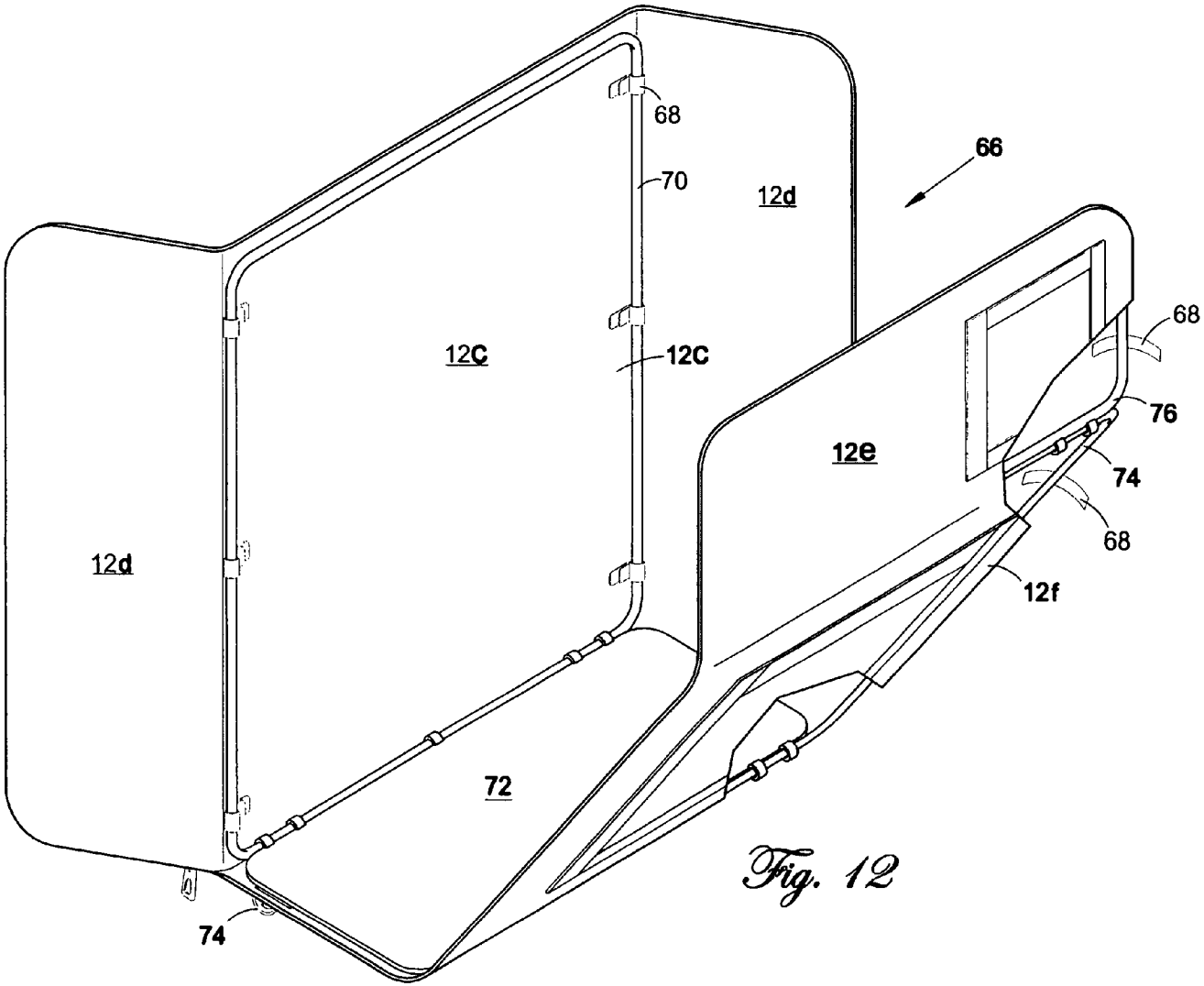
FIG. 12 illustrates a perspective view of a frame assembly for engagement with the panels of Applicant's novel container, which frame assembly is collapsible to lay flat so as to conform to the configuration as seen in FIG. 2 (unfolded).
Figure 13:
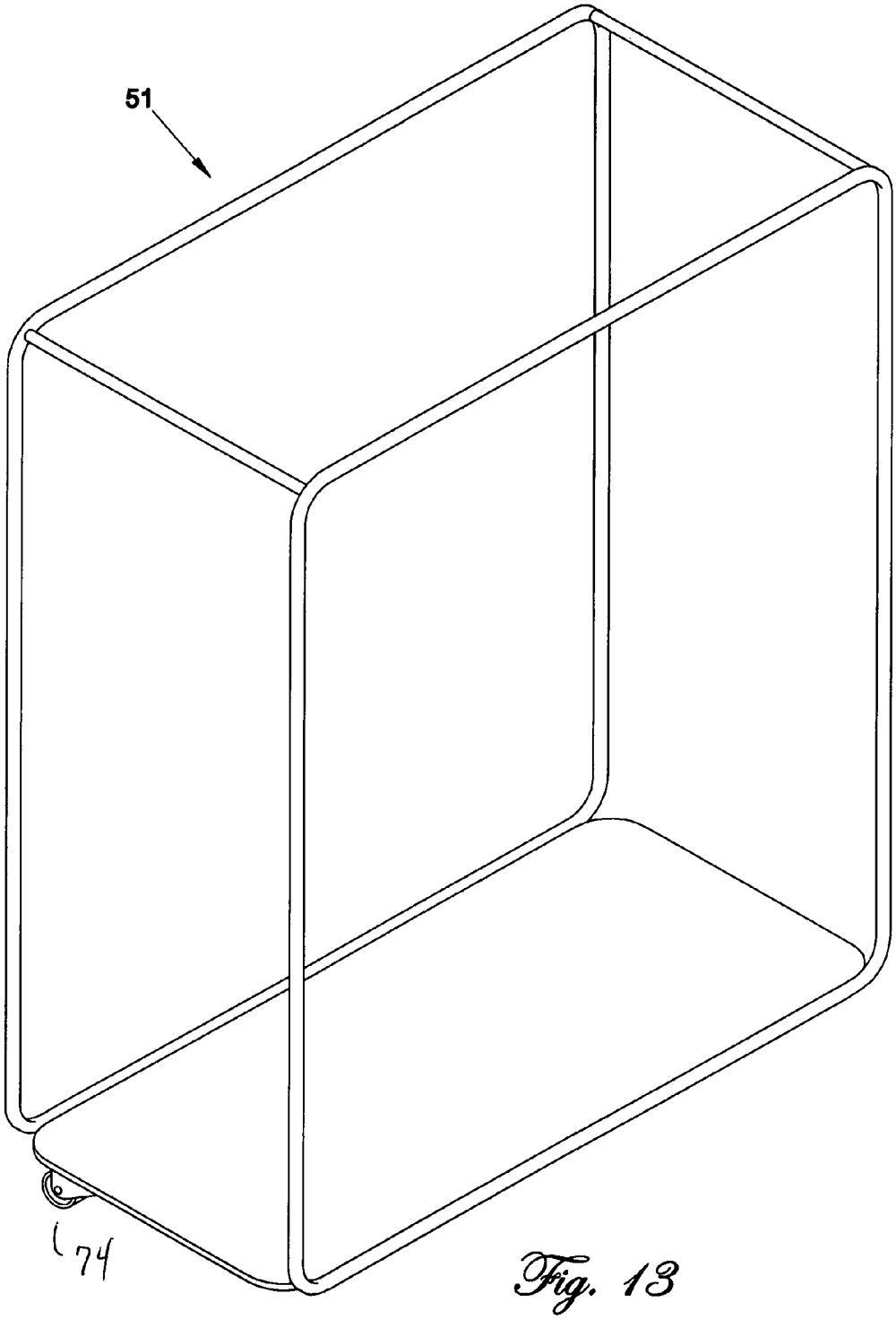
FIG. 13 illustrates a non-foldable frame that may be removed from the container.

FIGS. 12 and 13 illustrate embodiments of two different frames for use to support the container in a rectangular or folded condition as seen in FIG. 1. Internal frame 66 illustrated in FIG. 12 is made of a number of pivoting segments and is removably attached to the interior surface by means, including paired Velcro® straps 68.

One embodiment illustrated in FIG. 12 has a first rectangular segment 70 that defines the edges of a back wall 12*c* and is engaged along the edges defining a joinder of back wall 12*c* with side walls 12*d*. Frame segment 70 is pivotally engaged to a flat member 72 that would conform to the bottom wall of the rectangular structure, which flat member 72 may be tabular or may be made in a shape similar to that of frame segment 70, except defined by the borders of the bottom wall. In FIG. 12, flat member 72 (typically rigid) is seen to be a tabular member having a pair of pivoting wheels 74, which would mount outside the container surface. The wheels would allow the container to be wheeled along where the back wall edge meets the bottom wall edge, but typically with the flat member 72 (whether tabular or made of linear elements as seen in frame segment 70) inside the container when the container is in a closed configuration. An embodiment with four wheels (so as to be at the far corners of flat member 72) may also be used.

The pivotal arrangements of the remaining frame segments 74 and 76 conform generally to the dimensions of the rear wall and the top wall and are engaged typically with removable Velcro engagement straps 68. In this manner, the frame can be removed when the container is in an unfolded or flat position by moving one Velcro strap from the mating Velcro strap where they are joined to the various frame segments. However, it is seen that the frame will not prevent the container from being folded flat, but will, when the structure is in a folded position and zipped together, give rigidity to the assembly. This will help protect the contents of the backpack.

As seen in FIG. 13, a rigid frame 51 may be provided with tabs also to secure the frame to the panels. Rigid frame (without folding members), as with the segmented frame, may be used as an example with the embodiment of FIG. 2 and it may be used with or without securing tabs 68.

Figure 11:
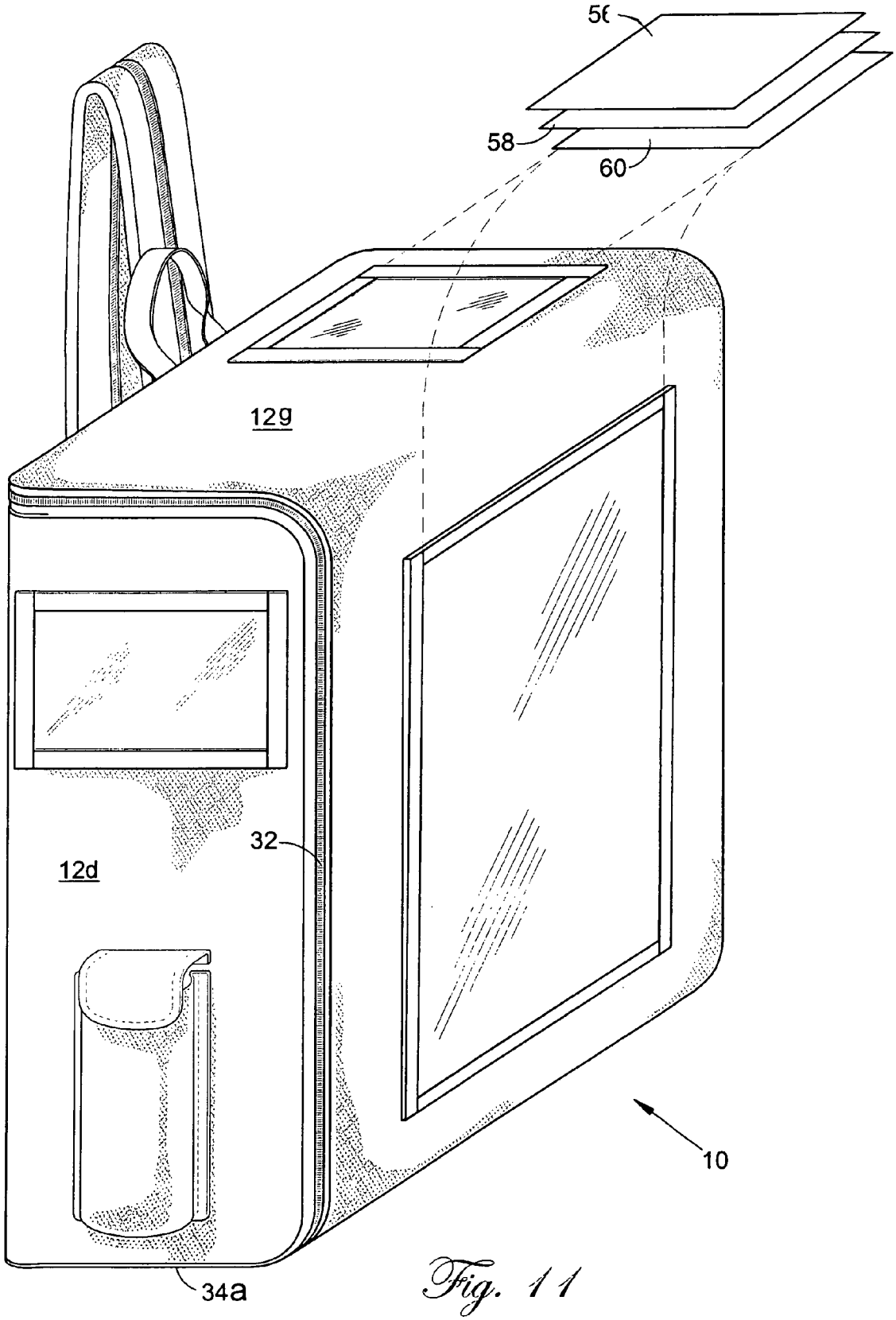
FIG. 11 illustrates a perspective view of a preferred embodiment of Applicant's novel container wherein a multiplicity of color cards are dimensioned for receipt into a pocket on the outside of the container, which pocket will have a clear or transparent cover for viewing the cards inserted thereon.

In FIG. 11, it is seen that a number of cards here, 56/58/60, may be provided, which cards are dimensioned for slideable receipt into a pocket which has a transparent or clear cover. The transparent cover of the pocket will allow the cards to be viewed. Moreover, in one particular embodiment, cards 56/58/60 differ from one another in their color. For example, card 56 may be red; card 58 blue; and card 60 white. These colors would typically contrast to the color of the material or fabric from which the panel is constructed so as to be clearly visible to one observing the storage container from a distance. Through the use of different colors, one may identify the contents, or at least the nature of the contents, of the container or identify one's container as their own. For example, containers that are similarly constructed and are of similar appearance, including being made of the same color material, may have contents that differ from one another. An indication of that difference to an observer, without opening the contents, would be use of the color cards 56/58/60. For example, if the containers were intended to carry medical instruments and supplies, red card 56 may indicate trauma instrument and supplies; blue card 58 may indicate supplies for heart attack patients; and white card 60 may suggest general emergency supplies. Further, indicia or illustrations may be provided on the cards. More than one pocket may be provided.

The term "clear" used herein refers to a material that one may readily see through, and may be tinted with a color while still allowing a view of the contents thereof.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

The invention claimed is:

1. A container comprising:

a panel adapted to lay flat in a first position and adapted to be folded into a generally rectangular shell in a second position, the shell defining an inner volume, the panel having an inner and outer surface;

a multiplicity of leaf pockets including means to removably attach leaf pockets to the inner surface of the panel;

a multiplicity of bulk pockets including means to removeably attach the bulk pockets to the inner surface of the panel; and a compartment comprising two sections, an upper sleeve comprising a clear cover and a lower sleeve with an opaque member between the upper and lower sleeves, wherein at least some of the multiplicity of bulk pockets and the multiplicity of leaf pockets are comprised of walls, at least some of which are non-opaque;

further including a frame dimensioned and capable of removable engagement from the panel, the frame adapted to maintain the panel in a rectangular configuration when in the second position;

wherein the frame comprises multiple segments engaging one another and capable of laying flat in a first position and folding into a rectangular shell in a second position; further comprising a multiplicity of wheels engaged therewith.

2. A container comprising:

a panel adapted to lay flat in a first position and adapted to be folded into a generally rectangular shell in a second position, the shell defining an inner volume, the panel having an inner and outer surface;

a multiplicity of leaf pockets including means to removably attach leaf pockets to the inner surface of the panel;

a multiplicity of bulk pockets including means to removeably attach the bulk pockets to the inner surface of the panel; and a compartment comprising two sections, an upper sleeve comprising a clear cover and a lower sleeve with an opaque member between the upper and lower sleeves, wherein at least some of the multiplicity of bulk pockets and the multiplicity of leaf pockets are comprised of walls, at least some of which are non-opaque;

wherein the upper sleeve is releasably sealed against the lower sleeve and the lower sleeve is releasably sealed to the outer surface of the panel.

3. A container comprising:

a panel adapted to lay flat in a first position and adapted to be folded into a generally rectangular shell in a second position, the shell defining an inner volume, the panel having an inner and outer surface;

a multiplicity of leaf pockets including means to removably attach leaf pockets to the inner surface of the panel;

a multiplicity of bulk pockets including means to removeably attach the bulk pockets to the inner surface of the panel; and a compartment comprising two sections, an upper sleeve comprising a clear cover and a lower sleeve with an opaque member between the upper and lower sleeves, wherein at least some of the multiplicity of bulk pockets and the multiplicity of leaf pockets are comprised of walls, at least some of which are non-opaque;

wherein the compartment is located on the outer surface of the panel; wherein the opaque member of the compartment is comprised of the same material which comprises the outer surface of the panel; and wherein the upper sleeve is releasably sealed against the lower sleeve and the lower sleeve is releasably sealed to the outer surface of the panel.

* * * * *